US006116145A

United States Patent [19]

Ota et al.

[11] Patent Number: 6,116,145

[45] Date of Patent: Sep. 12, 2000

[54] VARIABLE DISPLACEMENT COMPRESSOR

[75] Inventors: Masaki Ota; Hisakazu Kobayashi; Masaru Hamasaki; Masayoshi Hori, all of Kariya, Japan

[73] Assignee: Kabushiki Kaisha Toyoda Jidoshokki Seisakusho, Kariya, Japan

[21] Appl. No.: 09/030,242

[22] Filed: Feb. 25, 1998

[30] Foreign Application Priority Data

Feb. 28, 1997 [JP] Japan ..... 9-046648

[51] Int. Cl.[7] ..... F01B 3/00

[52] U.S. Cl. ..... 92/12.2; 92/71; 417/269

[58] Field of Search ..... 92/12.2, 57, 71; 417/269; 74/60

[56] References Cited

U.S. PATENT DOCUMENTS

| | | | |
|---|---|---|---|
| 4,846,049 | 7/1989 | Terauchi | 92/12.2 |
| 4,884,952 | 12/1989 | Kanamaru et al. | 92/12.2 X |
| 5,540,559 | 7/1996 | Kimura et al. | 417/222.2 |
| 5,749,712 | 5/1998 | Umemura | 417/269 |
| 5,779,004 | 7/1998 | Hoshino et al. | 417/269 X |

FOREIGN PATENT DOCUMENTS

| | | |
|---|---|---|
| 0547812 | 6/1993 | European Pat. Off. . |
| 3924347 | 2/1990 | Germany . |
| 19702399 | 7/1997 | Germany . |
| 4303184 | 10/1992 | Japan . |
| 63186973 | 8/1998 | Japan . |

*Primary Examiner*—Hoang Nguyen
*Attorney, Agent, or Firm*—Morgan & Finnegan, L.L.P.

[57] ABSTRACT

A variable displacement compressor includes a simplified hinge mechanism located between a rotary support and a swash plate. The hinge mechanism includes a swing arm extending from the swash plate and a pair of support arms extending from the rotary support such that the swing arm is placed between the support arms. A guide pin is attached to the swing arm. The guide pin has end portions engaging with guide holes of the support arms. Washers are located between the swing arm and the support arms to prevent the swing arm from directly contacting the support arms.

23 Claims, 5 Drawing Sheets

VARIABLE DISPLACEMENT COMPRESSOR

BACKGROUND OF THE INVENTION

The present invention relates to variable displacement compressors that are used in vehicle air conditioners.

Japanese Unexamined Patent Publication No. 4-303184 discloses such a compressor. The compressor according to the publication includes cylinder bores, a crank chamber, a suction chamber and a discharge chamber, which are defined in a housing. Each cylinder bore houses a piston. The compressor also has a drive shaft rotatably supported in the housing. A rotor is mounted on the drive shaft and is accommodated in the crank chamber. The crank chamber also accommodates a swash plate that slides along and tilts with respect to the axis of the drive shaft. The swash plate is coupled to the pistons. The swash plate is also coupled to the rotor by a hinge mechanism. The rotor and the hinge mechanism allow the swash plate to integrally rotate with the drive shaft. The hinge mechanism also allows the swash plate to slide along and to tilt with respect to the axis of the drive shaft between a maximum inclination position and a minimum inclination position.

The compressor further includes a displacement control valve. The control valve adjusts the pressure in the crank chamber, thereby changing the difference between the pressure in the crank chamber acting on one side of each piston and the pressure in the cylinder bores acting on the other side of the pistons. The changes in the pressure difference tilt the swash plate between the maximum inclination position and the minimum inclination position thereby changing the stroke of each piston. The displacement of the compressor is varied, accordingly.

The hinge mechanism includes a pair of support arms formed on the rotor and a pair of swing arms formed on the swash plate. An oblong guide hole is formed in each guide arm and a guide pin is press fitted in each swing arm. Each guide pin is slidably inserted in one of the guide holes. The guide holes define the path of the guide pins thereby guiding the tilting and the sliding of the swash plate on the axis of the drive shaft.

The compressor of the above publication has the following drawbacks:

The two swing arms complicate the shape of the swash plate. Accordingly, the machining of the swash plate is burdensome.

Since the pair of swing arms are arranged in a limited area on the swash plate, each swing arm is relatively small. It is therefore difficult to improve the strength and durability of the swing arms. Also, the small size of the swing arms results in a short length of the guide pins engaging with the swing arms. That is, the portion of each guide pin that is inserted into a swing arm is relatively short. It is therefore difficult to strengthen the connection between each guide pin and the associated swing arm.

The guide pins and the swing arms, which are separate parts, increase the number of parts in the hinge mechanism. This increases the number of the manufacturing steps and the manufacturing cost of the compressor.

SUMMARY OF THE INVENTION

Accordingly, it is an objective of the present invention to provide a variable displacement compressor that includes a hinge mechanism having a simple construction and a high durability.

To achieve the above objective, the variable displacement compressor according to the present invention includes a housing having a cylinder bore, a piston located in the cylinder bore, a drive shaft rotatably supported by the housing, a rotary support mounted on the drive shaft to rotate integrally with the drive shaft, and a drive plate operably connected to the piston to convert rotation of the drive shaft to reciprocation of the piston. The drive plate is supported tiltably on the drive shaft and is slidable in axial directions of the drive shaft. The piston moves by a stroke based on the inclination of the drive plate to change the displacement of the compressor. A hinge mechanism is located between the rotary support and the drive plate. The hinge mechanism rotates the drive plate integrally with the rotary support and guides the tilting motion and the sliding motion of the drive plate. The hinge mechanism includes a swing arm fixed to the drive plate and a pair of support arms fixed to the rotary support such that the swing arm is placed between the support arms with respect to a rotating direction of the drive plate. A projection extends from the swing arm toward each of the support arms. Each support arm has a guide opening for engaging the associated projection to guide the movement of the swing arm with respect to the support arm.

Also, the present invention provides a method for assembling a hinge mechanism in a variable displacement compressor. The method comprises: providing a swing arm, which is part of the hinge mechanism, on the drive plate; forming a through hole in the swing arm; providing a first support arm and a second support arm, which are parts of the hinge mechanism, on the rotary support, wherein the swing arm is placed between the first and second support arms with respect to a rotating direction of the drive plate, and wherein each support arm has a guide opening; press fitting a pin into the through hole from the guide opening of the second support arm, wherein each end of the pin projects from the through hole, and the ends of the pin engage with the guide openings of the first and second support arms to guide the movement of the swing arm with respect to the first and second support arms; and locating a spacer between the swing arm and the first support arm when the pin is press fitted into the through hole.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

FIG. 2(*a*) is an enlargement of a portion of FIG. 2;

FIG. 7(*b*) an enlarged partial top view illustrating surface treatment of a hinge mechanism according to yet another embodiment.

DETAILED DESCRIPTION OF THE PREFERRED EMBODIMENTS

A variable displacement compressor according to a first embodiment of the present invention will be described with reference to FIGS. 1 to 3. This compressor is used in a vehicle air conditioner system.

Figure 1:
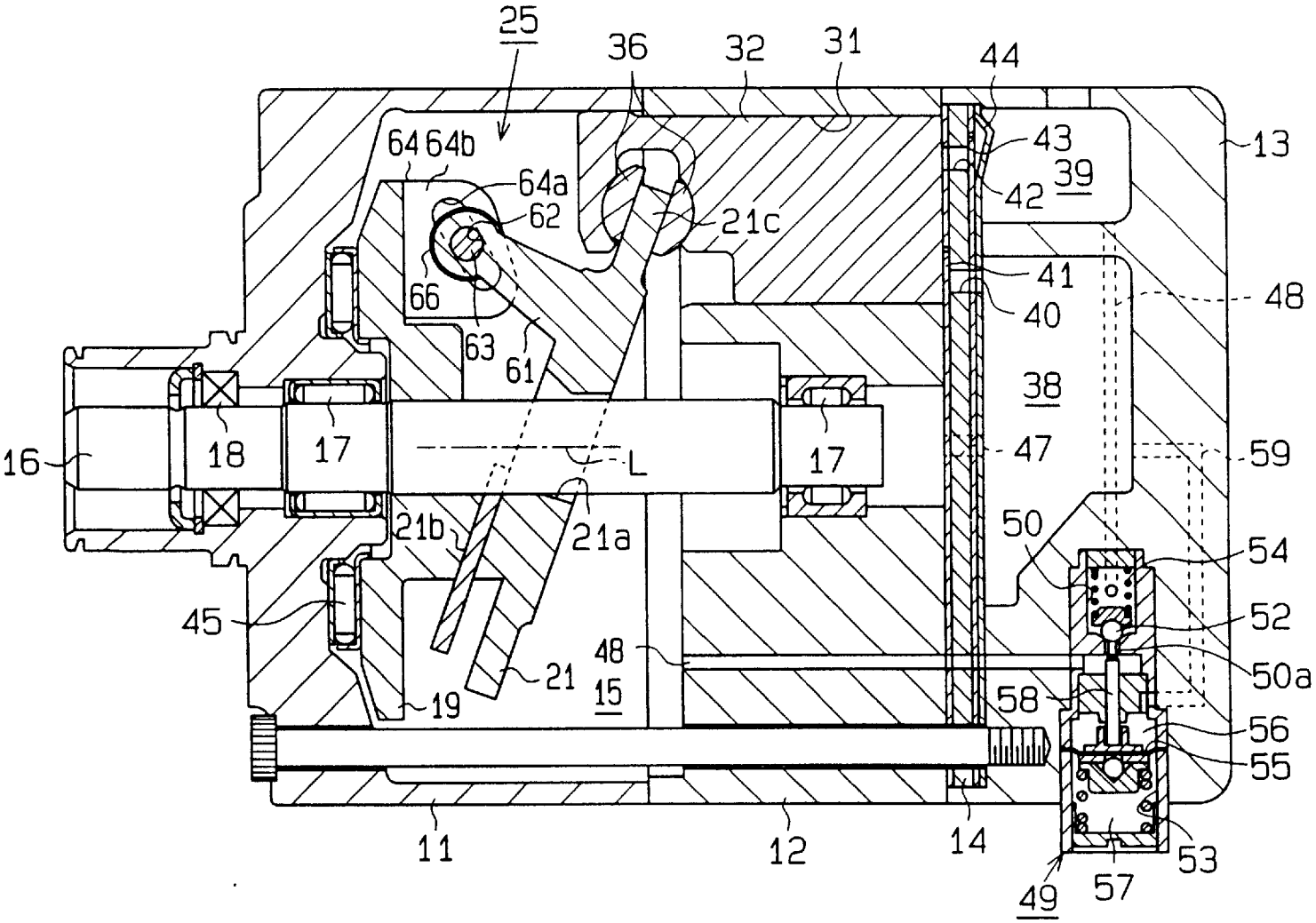
FIG. 1 is a cross-sectional view illustrating a variable displacement compressor according to a first embodiment of the present invention.
Figure 3:
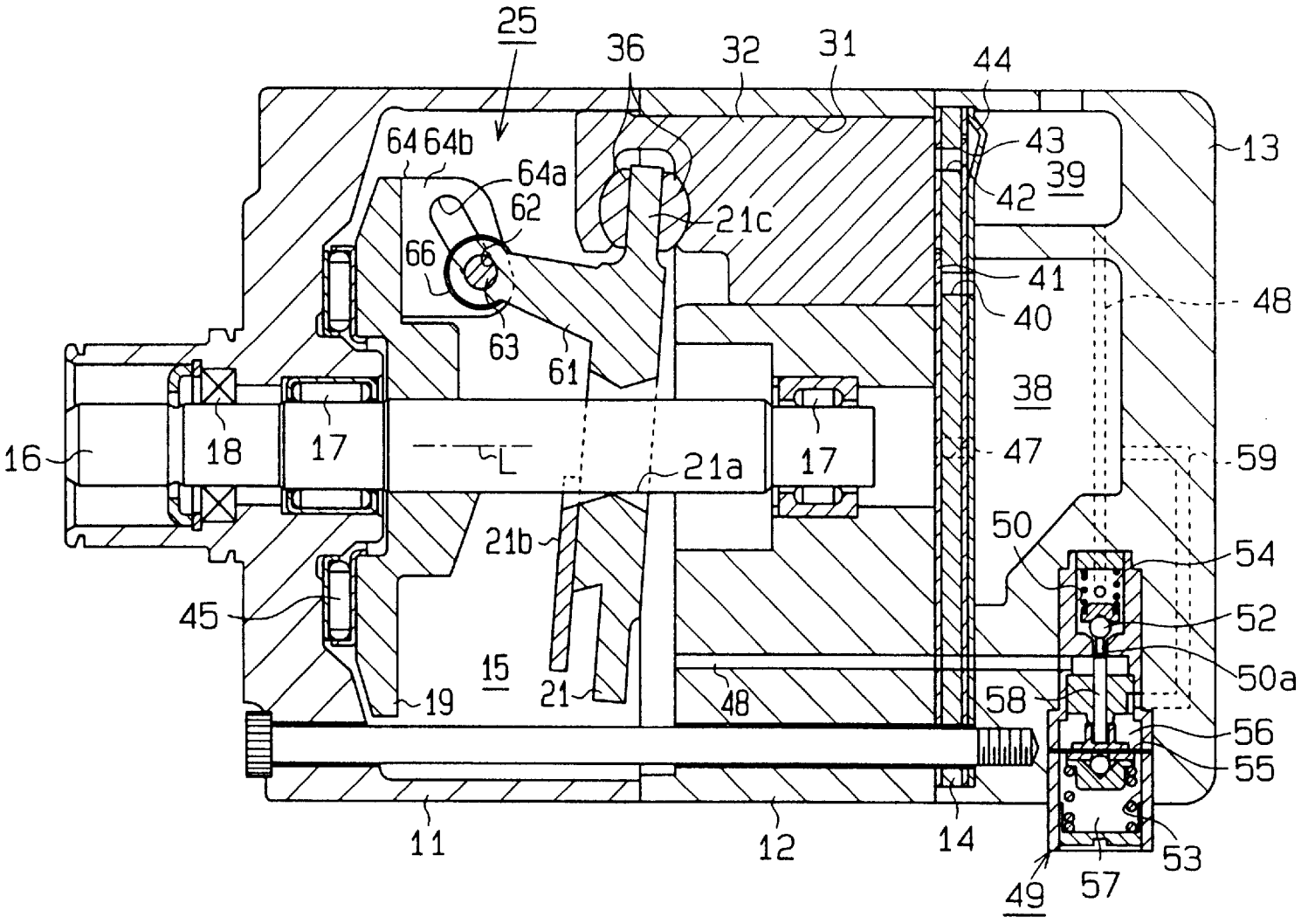
FIG. 3 is a cross-sectional view illustrating the compressor of FIG. 1 when the inclination of the swash plate is minimum.

As shown in FIGS. 1 and 3, a front housing 11 is coupled to the front end of a cylinder block 12. A rear housing 13 is coupled to the rear end of the cylinder block 12 with a valve plate 14 in between. The front housing 11, the cylinder block 12, and the rear housing 13 constitute a housing of the compressor.

The inner wall of the front housing 11 and the front face of the cylinder block 12 define a crank chamber 15. The crank chamber 15 accommodates a drive shaft 16 extending between the front housing 11 and the cylinder block 12. The drive shaft 16 is rotatably supported by a pair of bearings 17 located in the front housing 11 and in the cylinder block 12 and is coupled to an external drive source (not shown), or a vehicle engine, by a clutch mechanism such as an electromagnetic clutch. When the engine is running, the clutch operably connects the shaft 16 with the engine thereby rotating the shaft 16.

A lip seal 18 is located between the drive shaft 16 and the front housing 11 for sealing the crank chamber 15 from the outside of the compressor. The lip seal 18 prevents gas in the crank chamber 15 from leaking.

A rotor 19 is fixed to the rotary shaft 16 in the crank chamber 15. The crank chamber 15 also accommodates a swash plate 21. The swash plate 21 is made of aluminum or aluminum alloy and functions as a drive plate. A hole 21*a* is formed in the center of the swash plate 21. The drive shaft 16 extends through the hole 21*a* for supporting the swash plate 21. The engagement between the drive shaft 16 and the wall of the hole 21*a* of the swash plate 21 allows the sliding and tilting of the plate 21 with respect to the axis L of the shaft 16. The rotor 19 is coupled to the swash plate 21 by a hinge mechanism 25. The hinge mechanism 25 causes the swash plate 21 to rotate integrally with the rotor 19 and permits the sliding and the tilting of the swash plate 21 along the axis L of the drive shaft 16. The construction of the hinge mechanism 25 will be described further, below.

As shown in FIG. 3, abutment of the wall of the hole 21*a* against the drive shaft 16 limits the minimum inclination of the swash plate 21. A stopper 21*b* is secured to the front face of the swash plate 21. The abutment of the stopper 21*b* against the rear end face of the rotor 19 limits the maximum inclination of the swash plate 21.

The cylinder block 12 includes cylinder bores 31 (only one is shown) defined about the axis L of the drive shaft 16. Each cylinder bore 31 houses a single-headed piston 32. Each piston 32 is coupled to the swash plate 21 by a pair of semispherical shoes 36. The shoes 36 convert rotation of the swash plate 21 into linear reciprocation of the pistons 32 in the cylinder bores 31.

The rear housing 13 includes a suction chamber 38 and a discharge chamber 39. The valve plate 14 has suction ports 40, discharge ports 42, suction valve flaps 41 and discharge valve flaps 43. Each suction valve flap 41 corresponds to one of the suction ports 40 and each discharge valve flap 43 corresponds to one of the discharge ports 42. As each piston 32 moves from the top dead center to the bottom dead center in the associated cylinder bore 31, refrigerant gas in the suction chamber 38 is drawn into each cylinder bore 31 through the associated suction port 40 while causing the associated suction valve flap 41 to flex to an open position. As each piston 32 moves from the bottom dead center to the top dead center in the associated cylinder bore 31, refrigerant gas is discharged to the discharge chamber 39 through the associated discharge port 42 while causing the associated discharge valve flap 43 to flex to an open position. A retainer 44 is secured to the valve plate 14. The opening amount of each discharge valve flap 43 is defined by contact between the valve flap 43 and the retainer 44.

A thrust bearing 45 is located between the front housing 11 and the rotor 19. The front housing 11 receives the reaction force that acts on each piston 32 during compression of the gas by way of the swash plate 21, the hinge mechanism 25, the rotor 19 and the thrust bearing 45.

The crank chamber 15 is connected with the suction chamber 38 by a gas relieving passage 47 formed in the valve plate 14 and gaps in the rear radial bearing 17. The discharge chamber 39 is connected with the crank chamber 15 by a supply passage 48. The supply passage 48 is regulated by a displacement control valve 25 accommodated in the rear housing 13.

The control valve 49 includes a valve chamber 50 and a valve hole 50*a*, which constitute a part of the supply passage 48. The valve chamber 50 accommodates a valve body 52 and a spring 54. The valve body 52 opens and closes the valve hole 50*a*. The spring 54 urges the valve body 52 toward the valve hole 50*a*. The control valve 49 further includes a diaphragm chamber 53 that is separated from the valve chamber 50. The diaphragm chamber 53 is divided into pressure sensing chamber 56 and an atmospheric pressure chamber 57 by a diaphragm 55. The atmospheric pressure chamber 57 is communicated with the atmosphere. The diaphragm 55 is operably coupled to the valve body 52 by a rod 58. The pressure sensing chamber 56 is connected to the suction chamber 38 by a pressure introducing passage 59. The passage 59 communicates the pressure (suction pressure) in the suction chamber 38 with the pressure sensing chamber 56.

The diaphragm 55 is displaced by changes in the suction pressure and thus moves the valve body 52. Accordingly, the valve body 52 adjusts the opening of the valve hole 50*a*, or the opening of the supply passage 48. The supply passage 48 therefore changes the amount of refrigerant gas supplied to the crank chamber 15 from the discharge chamber 39. Changes in the pressure of the crank chamber 15 alter the difference between the pressure of the crank chamber 15, which acts on the bottom surface of each piston 32 (the left surface as viewed in FIG. 1), and the pressure of the associated cylinder bore 31, which acts on the head surface of the piston 32 (the right surface as viewed in FIG. 1). The inclination of the swash plate 21 is altered in accordance with changes in the pressure difference. This, in turn, alters the stroke of the pistons 32 and varies the displacement of the compressor.

If the cooling demand becomes great and the load applied to the compressor increases, high pressure in the suction chamber 38 acts on the diaphragm 55 causing the valve body 52 to narrow the valve hole 50*a*. This decreases the amount of refrigerant gas supplied to the crank chamber 15 from the discharge chamber 39 though the supply passage 48. In this state, the refrigerant gas in the crank chamber 15 is released into the suction chamber 38 through the relieving passage 47. This decreases the pressure in the crank chamber 15. As a result, the inclination of the swash plate 21 is increased, and the stroke of the pistons 32 is increased, accordingly. In this state, the compressor operates at a large displacement with lower suction pressure.

If the cooling demand decreases and the load applied to the compressor decreases, low pressure in the suction chamber 38 acts on the diaphragm 55 and causes the diaphragm 55 to move the valve body 52 to enlarge the valve hole 50*a*. Accordingly, the supply passage 48 increases the amount of refrigerant gas supplied to the crank chamber 15 from the discharge chamber 39. This increases the pressure in the crank chamber 15. As a result, the inclination of the swash plate 21 decreases, and the stroke of the pistons 32 decreases, accordingly. In this state, the compressor operates at a small displacement and with higher suction pressure.

In this manner, the control valve 49 optimally controls the displacement of the compressor in accordance with the suction pressure, which reflects the load applied to the compressor.

The construction of the hinge mechanism 25 will now be described.

Figure 2:
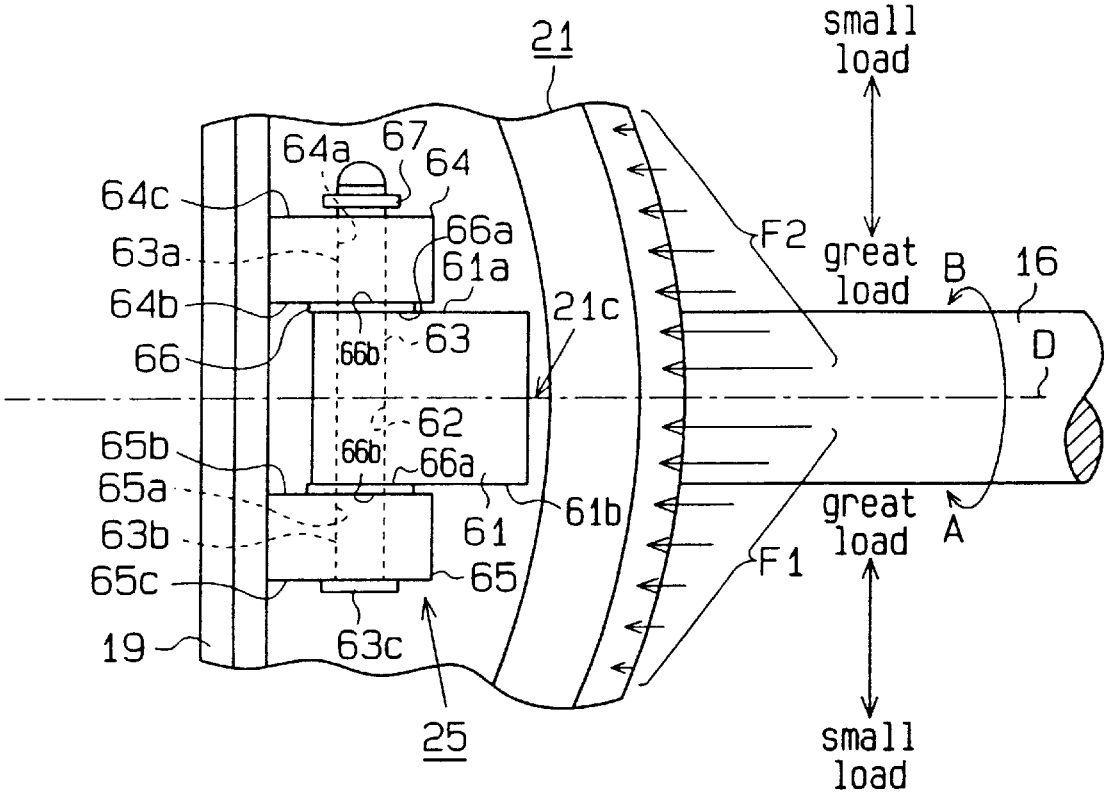
FIG. 2 is an enlarged partial top view illustrating a hinge mechanism.
Figure 2A:
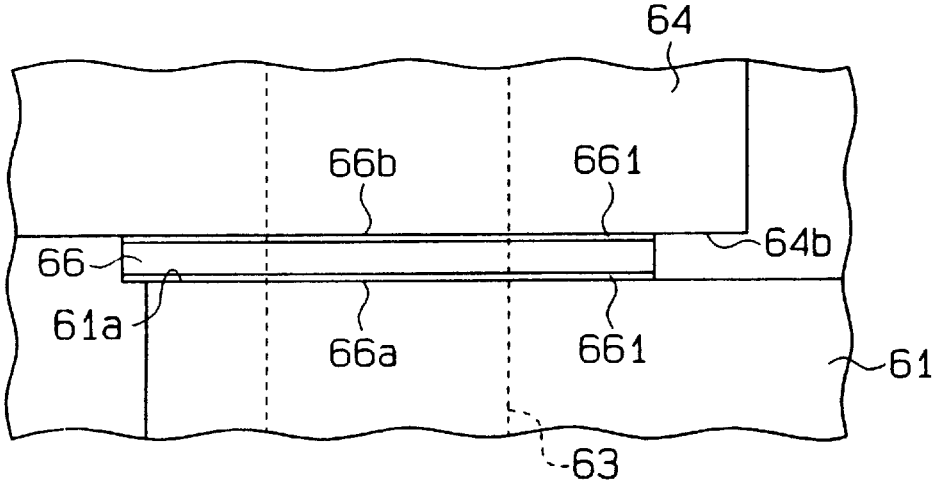

As shown in FIGS. 1 and 2, a swing arm 61 is integrally formed on the front face of the swash plate 21 and extends toward the rotor 19. The swash plate 21 includes a top dead center point 21*c* that positions each piston 32 at the top dead center. The point 21*c* lies in a plane D, in which the axis L also lies. The plane D is normal to the sheet of FIG. 2. The swing arm 61 is formed such that its center coincides with the plane D. The swing arm 61 has a hole 62 at the distal end. The hole 62 extends perpendicular to the axis L of the drive shaft 16. A guide pin 63, which made of iron-based metal, is press fitted into the hole 62. The guide pin 63 has a first end portion 63*a* and a second end portion 63*b*, which protrude from the sides of the swing arm 61.

A pair of support arms 64, 65 are integrally formed on the rear face of the rotor 19. The arms 64, 65 project toward the swash plate 21. The swing arm 61 is located between the support arms 64 and 65. The support arms 64, 65 are symmetrical with respect to the plane D. Therefore, the distance from the plane D to the outer surface 64*c* of the arm 64 is equal to the distance from the plane D to the outer surface 65*c* of the arm 65. Also, the distance from the plane D to the inner surface 64*b* of the arm 64 is equal to the distance from the plane D to the inner surface 65*b* of the arm 65.

The arms 64, 65 have oblong guide holes 64*a*, 65*a*, respectively. The holes 64*a*, 65*a* extend between the inner surfaces 64*b*, 65*b* and the outer surfaces 64*c*, 65*c* of the arms 64, 65. In their oblong direction, the holes 64*a*, 65*a* are inclined with respect to the drive shaft 16 as seen in FIG. 3. The first end portion 63*a* of the guide pin 63 is inserted in the guide hole 64*a* whereas the second end portion 63*b* is inserted in the other guide hole 65*a*.

Washers 66, which function as spacers, are located on the guide pin 63 between the sides 61*a*, 61*b* of the swing arm 61 and the inner surfaces 64*b*, 65*b* of the support arms 64, 65. Each washer 66 has an inner surface 66*a* that faces the sides 61*a*, 61*b* of the swing arm 61 and an outer surface 66*b* that faces the inner surfaces 64*b*, 65*b* of the support arms 64, 65. The surfaces 66*a*, 66*b* are treated for reducing sliding resistance. The surface treatment includes application of a layer 661, which is a coating of polytetrafluoroethylene or a layer of plating such as copper-plating, as shown in FIG. 2(*a*). The surface treatment also includes a hardening process such as cementation and chemical treatment such as nitrocarburizing.

The first and second end portions 63*a*, 63*b* of the guide pin 63 protrude from the outer surface 64*c*, 65*c* of the arms 64, 65. A flange 63*c* is formed at the end of the second end portion 63*b*. The diameter of the flange 63*c* is larger than the width of the guide holes 64*a*, 65*a*. A snap ring 67 is fitted to the first end portion 63*a*. The flange 63*c* and the snap ring 67 prevent the guide pin 63 from disengaging from the swing arm 61 and the support arms 64, 65.

The hinge mechanism 25 is assembled in the following manner. First, the swing arm 61 is placed between the support arms 64, 65 with the washers 66 located between the swing arm 61 and the support arms 64, 65. The first end portion 63*a* of the guide pin 63 is inserted in the guide hole 65*a* from the outer side 65*c* of the support arm 65. The first end portion 63*a* is pressed into the hole 62 of the swing arm 61 through the washer 66 between the arms 61, 65. The first end portion 63*a* is inserted in the guide hole 64*a* of the support arm 64 through the other washer 66 so that it extends from the outer surface 64*c* of the support arm 64. The snap ring 67 is then fitted to the first end portion 63*a*.

When the drive shaft 16 is rotated in direction A or in direction B as shown in FIG. 2, the torque is transmitted to the swash plate 21 by way of the rotor 19, one of the support arms 64, 65, one of the washers 66 and the swing arm 61. The support arm and washer that are located on the trailing side of the plane D with respect to the rotating direction of the drive shaft 16 transmit the torque. The end portions 63*a*, 63*b* of the guide pin 63 slide along the guide holes 64*a*, 65*a* and the wall of the swash plate hole 21*a* slides along the drive shaft 16. Accordingly, the swash plate 21 slides along and tilts with respect to the axis L of the drive shaft 16.

When the top dead center point 21*c* of the swash plate 21 has moved one of the pistons 32 to its top dead center position, that piston 32 has just finished discharging refrigerant gas from the associated cylinder bore 31. When the swash plate 21 is moving a piston 32 from the bottom dead center to the top dead center, the reaction force of gas compression acts on the swash plate 21. The resultant compression reaction acts on the swash plate 21 at a location that is on the leading side of the plane D with respect to the rotating direction of the swash plate 21.

When the load on the compressor is greater (for example, when the discharge pressure is higher), the resultant compression reaction force acts on the swash plate at a position closer to the plane D. When the load is smaller, the resultant force acts on the swash plate 21 at a position farther from the plane D. The resultant force is greater when the load on the compressor is greater and smaller when the load is smaller. Arrows F1 in FIG. 2 represent various compression reaction forces when the drive shaft 16 is rotating in direction A. Arrows F2 in FIG. 2 represent various compression reaction forces when the drive shaft 16 is rotating in direction B. The length of each arrow F1, F2 represents the magnitude force it represents. The position of each arrow F1, F2 indicates the location at which the represented force is applied to the swash plate 21. As shown in FIG. 2, when the load on the compressor is greater, a greater resultant F1, F2 of the compression reaction forces acts at a location closer to the plane D. When the load on the compressor is smaller, a smaller resultant F1, F2 acts at a location farther from the plane D.

Greater resultants F1, F2, which are produced when the cooling load is great, act on the swash plate 21 at positions closer to the plane D. Therefore, the great resultants F1, F2 are received by the rotor 19 by way of the arms 64 and 65, the swing arm 61 and the guide pin 63. Thus, even if a great compression reaction forces act on the swash plate 21, the reaction forces do not hinder the movement of the swash plate 21.

This embodiment has the following advantages.

The hinge mechanism 25 has a single swing arm 61. This simplifies the construction of the swash plate 21 in comparison to the prior art hinge mechanism, thereby facilitating machining of the swash plate 21.

The swing arm 61 is integrally formed with the swash plate 21 and the support arms 64, 65 are integrally formed with the rotor 19. This construction reduces the number of parts in the hinge mechanism 25 thereby reducing the cost.

The single swing arm 61 is formed in a limited area. This construction allows the swing arm 61 to be large compared to one of the swing arms of the prior art. The large size of the swing arm 61 guarantees adequate strength of the arm 61 and improves the durability of the hinge mechanism 25. This improves the reliability of the compressor. Further, a single guide pin 63 is press fitted in the swing arm 61. This construction allows a relatively long portion of the pin 63 to be engaged with the arm 61 thereby improving the strength of the connection between the guide pin 63 and the swing arm 61. The durability of the hinge mechanism 25 is therefore further improved and the compressor is made more reliable.

Compared to a swing arm made of iron or an iron alloy, the arm 61, which is made of aluminum or aluminum alloy, has less strength when engaged with the guide pin 63. However, as described above, this embodiment has a relatively long portion of the guide pin 63 engaged with the arm 61, which distributes force over a large area. Therefore, the swing arm 61 has sufficient strength.

The swing arm 61 is formed on the swash plate 21 such that the center of the arm 61 coincides with the plane D. The arms 64, 65 sandwich the swing arm 61 and are symmetrical with respect to the plane D. When the load on the compressor is great, the resultant of the compression reaction forces is also great. The great resultant force acts on the swash plate 21 at a location between the arms 64 and 65 during rotation of the drive shaft 16. Therefore, the swash plate 21 does not receive a great bending moment generated by the resultant compression reaction force. This prevents the swash plate 21 from becoming loose. The swash plate 21 is thus smoothly and quietly moved between the maximum inclination position and the minimum inclination position.

The washers 66 are located between the swing arm 61 and the support arms 65, 65, for preventing the support arms 64, 65 from contacting the swing arm 61 during rotation of the drive shaft 16 in either direction A or B. The washers 66 therefore minimize wear of the surfaces of the arms 64, 65 and 61.

When the guide pin 63 is pressed into the hole 62 of the swing arm 61, the side 61*a* of the arm 61 is pressed against the inner surface of the support arm 64*b*. However, the washer 66 prevents the swing arm 61 from directly contacting the support arm 64. The swing arm 61 and support arm 64 therefore do not wear against each other.

The sides 66*a*, 66*b* of the washer 66 are coated to reduce sliding resistance. The coating prevents the washers 66 and the arms 61, 64, 65 from wearing against each other. The coating also allows the swing arm 61 to smoothly move with respect to the support arms 64, 65. This results in a smooth tilting motion of the swash plate 21 thereby improving the responsiveness of the displacement control of the compressor.

The end portions 63*a*, 63*b* of the guide pin 63 are engaged with the guide holes 64*a*, 65*a* of the guide arms 64, 65. Compared to the prior art hinge mechanism, which has two guide pins attached to two swing arms, the hinge mechanism 25 has fewer parts. This decreases the number of manufacturing steps and the manufacturing cost of the compressor.

The guide pin 63 is press fitted into the hole 62 of the swing arm 61. The head 63*c* and the snap 67 prevent the pin 63 from disengaging from the hole 62. This construction double-locks the engagement of the pin 63 with the hole 62 thereby improving the reliability of the hinge mechanism 25.

The swash plate 21 is made of aluminum or aluminum alloy, which is light. The swash plate 21 therefore reduces the weight of the compressor. The light swash plate 21 also improves the compressor's responsiveness in controlling of displacement.

The compressor of FIGS. 1 to 3 operates with the drive shaft 16 rotated in either direction A or B. The compressor therefore eliminates the necessity for manufacturing two different types of compressors for meeting the demands of users. This further lowers the manufacturing cost of the compressor.

A second embodiment of the present invention will now be described with reference to FIG. 4. The differences from the first embodiment will mainly be discussed below.

The compressor of this embodiment includes a drive shaft 16 and a hinge mechanism 71. The drive shaft 16 is rotated in only one direction A. The resultant compression reaction force acts on the swash plate 21 at a location on the leading side of the plane D with respect to the rotating direction A. As in FIG. 2, arrows F1 in FIG. 4 represent the various resultant reaction forces when the drive shaft 16 is rotated in direction A.

The hinge mechanism 71 includes a swing arm 61. The center of the swing arm 61 is displaced from the plane D. Specifically, the swing arm 61 is displaced towards the leading side of the plane D with respect to the rotating direction A of the swash plate 21. The positions of support arms 64, 65 are also displaced to the leading side of the plane D in the rotating direction A compared to the positions of the arms 64, 65 in the compressor of FIG. 2. As in FIG. 2, the plane D includes the top dead center point 21*c* of the swash plate 21 and the axis L of the drive shaft 16. The distance between the plane D and the outer surface 65*c* of the leading support arm 65 is greater than the distance between the plane D and the outer surface 64*c* of the trailing support arm 64. The hinge mechanism 71 has a single washer 66 located between the swing arm 71 and the support arm 64.

Figure 4:
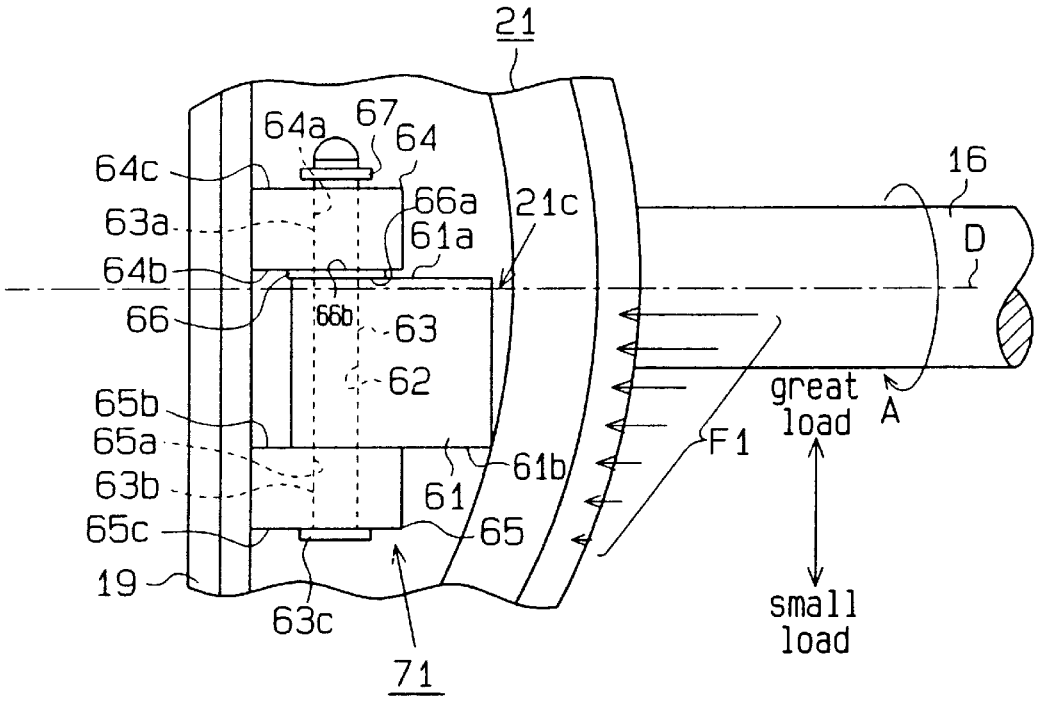
FIG. 4 is an enlarged partial top view illustrating a hinge mechanism according to a second embodiment.

As shown in FIG. 4, the minimum resultant F1 is closer to the swing arm 61 than that of the embodiment of FIG. 2. In the embodiment of FIG. 2, the minimum resultant F1 is offset from the swing arm 61 by a greater distance. In other words, the hinge mechanism 71 is better aligned with the smaller resultant forces, which are generated when the load on the compressor is small. Therefore, the hinge mechanism 71 reduces the bending moment on the swash plate 21, which is generated by compression reaction forces not only when the load on the compressor is great, but also when the load is small. The swash plate 21 is thus stable and smoothly operated.

Torque from the drive shaft 16 is transmitted to the swash plate 21 through the rotor 19, the support arm 64 and the swing arm 61. Therefore, only the trailing support arm 64 transfers the torque. Also, as in the compressor of FIGS. 1 to 3, the guide pin 63 is pressed in the guide hole 65*a* from the support arm 65 to the support arm 64 through the swing arm 61. Thus, the inner surface 64*b* of the support arm 64 and the trailing side 61*a* of the swing arm 61 are more likely to be damaged during operation and assembly. Therefore, a washer 66 is needed only between the swing arm 61 and the support arm 64.

As described above, in a compressor having the drive shaft 16 that rotates in only one direction A, determining the inserting direction of guide pin 63 in accordance with the rotating direction of the drive shaft 16 reduces the number of the washers 66. The compressor of FIG. 4 therefore has fewer parts compared to the compressor of FIG. 2. This reduces the weight of the compressor and the manufacturing cost.

A third embodiment of the present invention will now be described with reference to FIG. 5. The differences from the first embodiment will mainly be discussed below.

Figure 5:
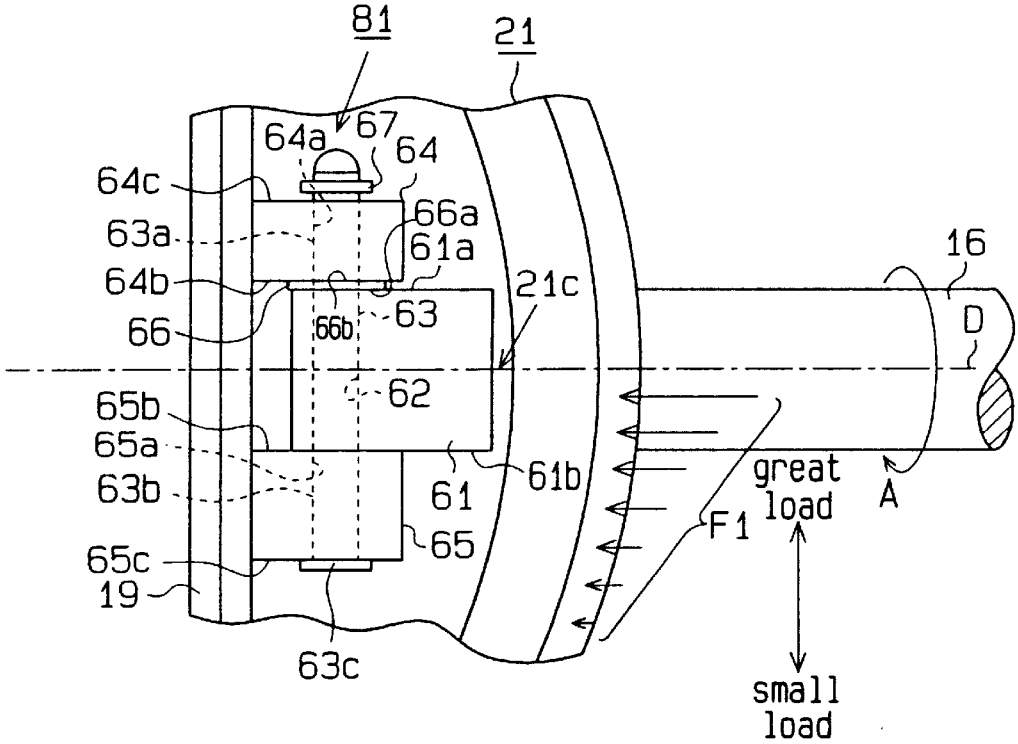
FIG. 5 is an enlarged partial top view illustrating a hinge mechanism according to a third embodiment.

As in the compressor of FIG. 4, the drive shaft 16 of the compressor of FIG. 5 is rotated in a single direction A. As shown in FIG. 5, a hinge mechanism 81 includes support arms 64 and 65. The support arm 65 is located on the leading side of the plane D with respect to the rotating direction A of the drive shaft 16. The support arm 65 is wider in the direction normal to the plane D than the arm 64. In other words, the support arm 65 is enlarged. The distance between the plane D and the outer surface 65*c* of the leading support arm 65 is greater than the distance between the plane D and outer surface 64*c* of the trailing support arm 64. In other words, the support arms 64, 65 are asymmetrical with respect to the plane D.

The resultant of the compression reaction forces acts on the swash plate 21 at the leading side of the plane D with respect to the rotating direction A of the swash plate 21. Therefore, the leading support arm 65 receives a greater compression reaction force than the trailing support arm 64. However, since the leading support arm 65 is larger and has better strength, the arm 65 easily withstands the greater reaction force.

For the same reason mentioned in the discussion of FIG. 4, a washer 66 is located only on the trailing side of the plane D in the compressor of FIG. 5.

A fourth embodiment of the present invention will now be described with reference to FIG. 6. The differences from the first embodiment will mainly be discussed. In a hinge mechanism 91 of this embodiment, the first end portion 63*a* of a guide pin 63 includes a small diameter portion 63*d*. When inserting the guide pin 63 in the hole 62 of the swing arm 61, the small diameter portion 63*d* enters the hole 62 first. This facilitates press fitting of the rest of the guide pin 63 into the hole 62.

The present invention may be alternatively embodied in the following forms:

In the hinge mechanisms of FIGS. 1 to 6, the washers 66 may be omitted. In this case, surface treatment is applied to the sides 61*a*, 61*b* of the swing arm 61 and/or on the inner surfaces 64*b*, 65*b* of the support arms 64, 65 for reducing sliding resistance. The surface treatment is the same as the treatment given to the washers 66. That is, as shown in FIG. 7(*a*), the surface treatment includes application of a layer 661, which is a coating of polytetrafluoroethylene or is plating such as copper-plating. The surface treatment also includes a hardening process such as cementation and chemical treatment such as nitrocarburizing.

The surface treatment is especially effective when applied to the support arm 64, which transmits torque of the drive shaft 16 to the swing arm 61, and to the swing arm side facing the arm 64. In the embodiments of FIGS. 1 to 3 and FIG. 6, the drive shaft 16 rotates in either direction A or B. In these embodiments, surface treatment is applied to the sides 61*a*, 61*b* of the swing arm 61 and/or on the inner surfaces 64*b*, 65*b* of the support arms 64, 65. In the embodiments of FIG. 4 and FIG. 5, the drive shaft 16 is rotated in only one direction. In these embodiments, surface treatment is applied at least on the inner side 64*b* of the trailing support arm 64 and/or the support arm side 61*a*, which faces the side 64*b*.

In the embodiments of FIGS. 1 to 6, surface treatment may also be applied to the inner walls of guide holes 64*a*, 65*a* and/or to the surfaces of the first and second end portions 63*a*, 63*b* of the guide pin 63 as shown in FIG. 7(*b*) for reducing sliding resistance. The surface treatment is the same as the treatment on the washers 66.

Compression reaction forces acting on the swash plate 21 are received by the inner walls of the guide holes 64*a*, 65*a* through the swing arm 61 and the end portions 63*a*, 63*b* of the guide pin 63. Therefore, surface treatment is applied at least to the force receiving part of the guide pin 63 and the force receiving part of the guide holes 64*a*, 65*a*. In the compressor of FIGS. 4 and 5, the drive shaft 16 is rotated in one direction. In these compressors, the support arm 65 receives a greater compression reaction force than the support arm 64. Therefore, surface treatment is applied at least to the sliding parts of the guide hole 65*a* and to a part of the second end portion 63*b* that contacts the guide hole 65*a*.

Figure 6:
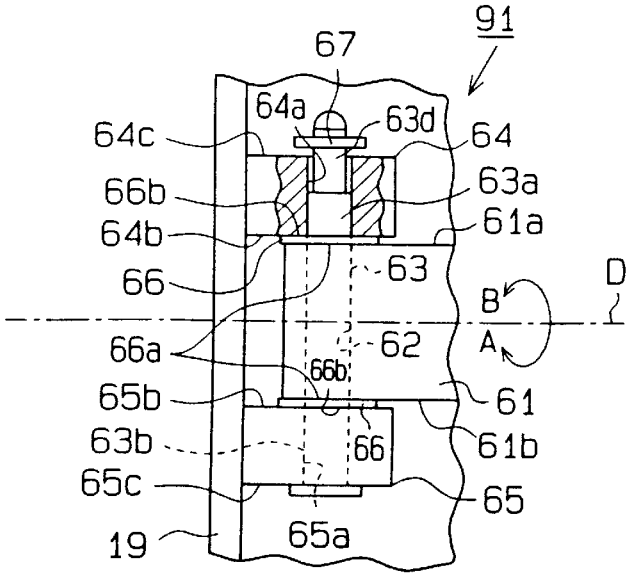
FIG. 6 is an enlarged partial view top illustrating a hinge mechanism according to a fourth embodiment.
Figure 7A:
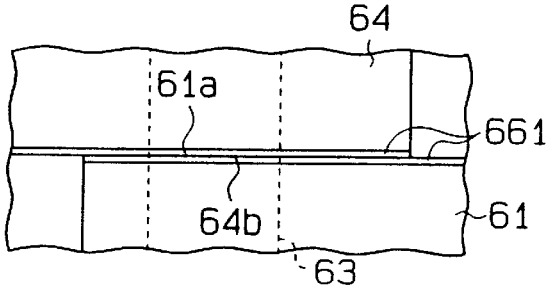
FIG. 7(*a*) an enlarged partial top view illustrating surface treatment of a hinge mechanism according to another embodiment.
Figure 7B:
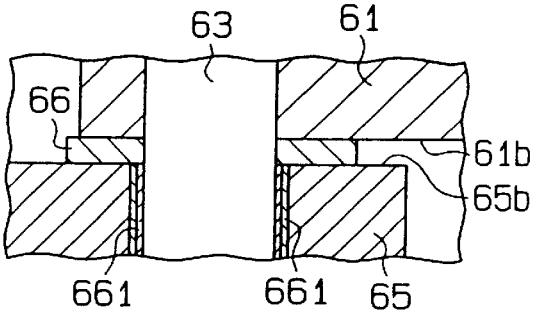

The construction of FIG. 6 may be used in the compressors of FIGS. 4 and 5, in which the drive shaft 16 is rotated in only one direction. In this case, the compression reaction force acting on the first end portion 63*a* of the guide pin 63 is smaller than that acting on the second end portion 63*b*. Therefore, even if the pin area contacting the guide hole 64*a* is reduced by the small diameter portion 63*d*, the performance of the hinge mechanism 71, 81 is not hindered.

The diameter of the hole 62 may be larger than the diameter of the guide pin 63. In this case, the guide pin 63 is not press fitted in the hole 62 and is prevented from disengaging from the hole 62 by the head 63*c* and the snap ring 67. Alternatively, the guide pin 63 may be threaded like a bolt. In this case, a nut is screwed to one end of the pin 63 for preventing the guide pin 63 from disengaging from the hole 62.

The snap ring 67 and the head 63*c* may be omitted from the guide pin 63. In this case, the guide pin is merely press fitted into the hole 62 for preventing the pin 63 from disengaging from the hole 62. This simplifies the assembly of the hinge mechanism.

In the embodiments of FIGS. 1 to 6, the washers 66 may be omitted. In this case, the swing arm 61 is positioned between the support arms 64 and 65, and a spacer is placed between the swing arm 61 and the support arm 64. The guide pin 63 is then fitted in the hole 62 of the swing arm 61 from the guide hole 65*a*. Thereafter, the spacer is removed. The spacer prevents the support arm 64 and the swing arm 61 from damaging each other when the pin 63 is being press fitted.

Therefore, the present examples and embodiments are to be considered as illustrative and not restrictive and the invention is not to be limited to the details given herein, but may be modified within the scope and equivalence of the appended claims.

What is claimed is:

1. A variable displacement compressor comprising:

a housing having a cylinder bore;

piston located in the cylinder bore;

a drive shaft rotatably supported by the housing;

a rotary support mounted on the drive shaft to rotate integrally with the drive shaft;

a drive plate operably connected to the piston to convert rotation of the drive shaft to reciprocation of the piston, wherein the drive plate is supported tiltably on the drive shaft and is slidable in axial directions of the drive shaft, and the piston moves by a stroke based on the inclination of the drive plate to change the displacement of the compressor; and a hinge mechanism located between the rotary support and the drive plate, wherein the hinge mechanism rotates the drive plate integrally with the rotary support and guides the tilting motion and the sliding motion of the drive plate, the hinge mechanism including a swing arm fixed to the drive plate and a pair of support arms fixed to a rotary support such that the swing arm is placed between the support arms with respect to a rotating direction of the drive plate, the hinge mechanism further including a projection extending from the swing arm toward each of the support arms, wherein each support arm has a guide opening for engaging the associated projection to guide the movement of the swing arm with respect to the support arm.

2. The compressor according to claim 1, wherein the drive plate has a top dead center point for positioning the piston at a top dead center position in the cylinder bore, and a longitudinal axis of the swing arm is aligned with the top dead center point.

3. The compressor according to claim 1, wherein the drive plate has a top dead center point for positioning the piston at a top dead center position in the cylinder bore, wherein the support arms are symmetric with respect to a plane that includes the top dead center point and the axis of the drive shaft.

4. The compressor according to claim 1, wherein the drive plate has a top dead center point for positioning the piston at a top dead center position in the cylinder bore, wherein the support arms are asymmetric with respect to a plane that includes the top dead center point and the axis of the drive shaft.

5. The compressor according to claim 4, wherein the support arms include a leading support arm and a trailing support arm, wherein the leading support arm is located at a leading side of the plane and the trailing support arm is located at a trailing side of the plane with respect to the rotating direction of the drive plate, and wherein the leading support arm is located further from the plane than the trailing support arm.

6. The compressor according to claim 4, wherein the support arms include a leading support arm and a trailing support arm, wherein the leading support arm is located at a leading side of the plane and the trailing support arm is located at a trailing side of the plane with respect to the rotating direction of the drive plate, wherein the leading support arm is wider than the trailing support arm as measured in a direction perpendicular to the plane.

7. The compressor according to claim 1, wherein the hinge mechanism further includes a spacer located between the swing arm and a first one of the support arms to prevent the swing arm from directly contacting the first support arm.

8. The compressor according to claim 7, wherein the first support arm is trails the second support arm with respect to the rotating direction of the drive plate.

9. The compressor according to claim 1, wherein the swing arm has a through hole, and wherein the projections are formed by a pin, which is press fitted into the through hole from the guide opening of the second support arm, wherein one end of the pin projects from each end of the through hole, wherein each end of the pin is received by a corresponding one of the guide openings.

10. The compressor according to claim 7, wherein the spacer has an inner surface facing the swing arm and an outer surface facing the first support arm, wherein a friction reducing surface treatment is applied to at least one of the inner surface and the outer surface to reduce sliding resistance.

11. The compressor according to claim 1, wherein a friction reducing surface treatment is applied to one of the projections or to a load-bearing surface of one of the guide openings to reduce sliding resistance.

12. The compressor according to claim 1, wherein the drive plate is made of a material including aluminum.

13. The compressor according to claim 1, wherein the swing arm is formed integrally with the drive plate.

14. The compressor according to claim 1, wherein the support arms are formed integrally with the rotary support.

15. The compressor according to claim 1, wherein the swing arm has a pair of outer surfaces facing the support arms, wherein each support arm has an inner surface facing the swing arm, and wherein a friction reducing surface treatment is applied to at least one of the outer and inner surfaces to reduce sliding resistance.

16. The compressor according to claim 15, wherein the support arms include a first support arm and a second support arm, wherein the first support arm trails the second support arm with respect to the rotating direction of the drive plate, and wherein the surface treatment is applied to at least one of the inner surface of the first support arm and the outer surface that faces the first support arm.

17. A variable displacement compressor comprising:

a housing having a cylinder bore;

a piston located in the cylinder bore;

a drive shaft rotatably supported by the housing;

a rotary support mounted on the drive shaft to rotate integrally with the drive shaft;

a drive plate operably connected to the piston to convert rotation of the drive shaft to reciprocation of the piston, wherein the drive plate is supported tiltably on the drive shaft and is slidable in axial directions of the drive shaft, wherein the piston moves by a stroke based on the inclination of the drive plate to change the displacement of the compressor;

a hinge mechanism located between the rotary support and the drive plate, wherein the hinge mechanism rotates the drive plate integrally with the rotary support and guides the tilting motion and the sliding motion of the drive plate, wherein the hinge mechanism includes a swing arm extending from the drive plate, a pair of support arms extending from the rotary support such that the swing arm is placed between the support arms with respect to a rotating direction of the drive plate, and a pin attached to the swing arm, wherein the pin has ends projecting from the swing arm toward the support arms, wherein each support arm has a guide opening for engaging with a corresponding end of the pin to guide the movement of the swing arm with respect to the support arm; and a spacer located between the swing arm and a first one of the support arms to prevent the swing arm from directly contacting the first support arm.

18. The compressor according to claim 17, wherein the drive plate has a top dead center point for positioning the piston at a top dead center position in the cylinder bore, wherein a longitudinal axis of the swing arm is aligned with the top dead center point or is displaced from the top dead center point in a leading direction with respect to the rotating direction of the drive plate.

19. The compressor according to claim 17, wherein the drive plate has a top dead center point for positioning the piston at a top dead center position in the cylinder bore, wherein the support arms are symmetric with respect to a plane that includes the top dead center point and the axis of the drive shaft.

20. The compressor according to claim 17, wherein the drive plate has a top dead center point for positioning the piston at a top dead center position in the cylinder bore, wherein the support arms include a leading support arm and a trailing support arm, wherein the leading support arm is located at a leading side of the top dead center point and the trailing support arm is located at a trailing side of the top dead center point with respect to the rotating direction of the drive plate, and wherein the leading support arm is located further from the top dead center point than the trailing support arm.

21. The compressor according to claim 17, wherein the drive plate has a top dead center point for positioning the piston at a top dead center position in the cylinder bore, wherein the support arms include a leading support arm and a trailing support arm, wherein the leading support arm is located at a leading side of the top dead center point and the trailing support arm is located at a trailing side of the top dead center point with respect to the rotating direction of the drive plate, wherein the leading support arm is wider than the trailing support arm as measured in the rotating direction of the drive plate.

22. A method for assembling a hinge mechanism in a variable displacement compressor, wherein the compressor includes a rotary support mounted on a drive shaft to rotate integrally with the drive shaft and a drive plate operably connected to a piston to convert rotation of the drive shaft to reciprocation of the piston in a cylinder bore, wherein the drive plate is supported tiltably on the drive shaft and is slidable in axial directions of the drive shaft, wherein the piston moves by a stroke based on the inclination of the drive plate to change the displacement of the compressor, wherein the hinge mechanism is located between the rotary support and the drive plate, wherein the hinge mechanism rotates the drive plate integrally with the rotary support and guides the tilting motion and the sliding motion of the drive plate, the method comprising:

providing a swing arm, which is part of the hinge mechanism, on the drive plate;

forming a through hole in the swing arm;

providing a first support arm and a second support arm, which are parts of the hinge mechanism, on the rotary support, wherein the swing arm is placed between the first and second support arms with respect to a rotating direction of the drive plate, and wherein each support arm has a guide opening;

press fitting a pin into the through hole from the guide opening of the second support arm, wherein each end of the pin projects from the through hole, wherein the ends of the pin engage with the guide openings of the first and second support arms to guide the movement of the swing arm with respect to the first and second support arms; and locating a spacer between the swing arm and the first support arm when the pin is press fitted into the through hole.

23. The compressor according to claim 1, wherein the drive plate has a top dead center point for positioning the piston at a top dead center position in the cylinder bore, and a longitudinal axis of the swing arm is displaced from the top dead center point in a leading direction with respect to the rotating direction of the drive plate.

* * * * *